US009814304B2

(12) United States Patent
Jeanphilippe

(10) Patent No.: US 9,814,304 B2
(45) Date of Patent: Nov. 14, 2017

(54) PORTABLE OFFICE

(71) Applicant: Wesnel Jeanphilippe, East Orange, NJ (US)

(72) Inventor: Wesnel Jeanphilippe, East Orange, NJ (US)

( * ) Notice: Subject to any disclaimer, the term of this patent is extended or adjusted under 35 U.S.C. 154(b) by 0 days.

(21) Appl. No.: 15/082,811

(22) Filed: Mar. 28, 2016

(65) Prior Publication Data

US 2017/0273451 A1 Sep. 28, 2017

(51) Int. Cl.

| | |
|---|---|
| ***A47B 39/00*** | (2006.01) |
| ***A47B 3/14*** | (2006.01) |
| ***A47B 83/02*** | (2006.01) |
| ***A47B 9/20*** | (2006.01) |
| ***A47B 9/14*** | (2006.01) |
| ***A47G 23/02*** | (2006.01) |
| ***A47C 7/40*** | (2006.01) |
| ***A47B 13/16*** | (2006.01) |
| ***A47B 3/06*** | (2006.01) |
| ***A47B 3/08*** | (2006.01) |
| ***A47C 4/28*** | (2006.01) |
| ***A47C 4/04*** | (2006.01) |
| ***F21V 33/00*** | (2006.01) |

(52) U.S. Cl.

CPC ..... *A47B 3/14* (2013.01); *A47B 3/06* (2013.01); *A47B 3/08* (2013.01); *A47B 9/14* (2013.01); *A47B 9/20* (2013.01); *A47B 13/16* (2013.01); *A47B 83/02* (2013.01); *A47C 4/04* (2013.01); *A47C 4/28* (2013.01); *A47C 7/407* (2013.01); *A47G 23/0225* (2013.01); *F21V 33/0012* (2013.01); *A47B 2083/025* (2013.01)

(58) Field of Classification Search

CPC ..... A47B 83/008; A47B 83/02; A47B 3/14; A47B 2003/145; A47B 2200/0072; A47B 2200/0096

USPC ..... 297/174 R, 135, 139; 108/26, 23, 50.01

See application file for complete search history.

(56) References Cited

U.S. PATENT DOCUMENTS

| | | | | |
|---|---|---|---|---|
| 33,392 A | | 10/1861 | Hunzinger | |
| 2,098,655 A | * | 11/1937 | De Lisle | A47B 19/06 248/599 |
| 2,252,224 A | * | 8/1941 | Welsh | A47D 13/105 248/370 |
| D145,659 S | * | 10/1946 | Covington | 297/156 |

(Continued)

FOREIGN PATENT DOCUMENTS

| | | |
|---|---|---|
| CA | 2093248 | 10/1993 |
| CA | 2443785 | 11/2002 |

(Continued)

*Primary Examiner* — Jose V Chen

(74) *Attorney, Agent, or Firm* — Gearhart Law LLC

(57) ABSTRACT

A portable desk apparatus that allows a user to enjoy a complete office experience is provided for. In a preferred embodiment, the portable desk is comprised of a separably attached desk portion and seat portion. The desk portion is preferably constructed out of a desk member, a slip light, a foldable cup holder, a desk support member, a desk attachment mechanism, a desk extension member, and at least one ground support member. The chair portion is preferably constructed out of a seat member, two pairs of legs equipped with two support members, and a foldable seat back member. The entire apparatus may be collapsed for each transportation or storage, and may be extended to be used as an office.

10 Claims, 5 Drawing Sheets

(56) References Cited

U.S. PATENT DOCUMENTS 3,178,220 A 4/1965 Haake
4,798,411 A * 1/1989 Lin ..... A47B 3/14 297/170
4,915,450 A * 4/1990 Cooper ..... F16M 11/10 248/919
5,158,074 A * 10/1992 Grellas ..... A61H 1/0274 297/188.21
D348,569 S * 7/1994 Haussmann ..... D6/338
5,413,400 A 5/1995 Llanes
5,542,360 A * 8/1996 Fleming ..... A47B 23/04 108/23
5,560,676 A 10/1996 Roberts et al.
5,685,602 A 11/1997 Williams
5,695,264 A 12/1997 Koch
5,697,668 A 12/1997 Chao
5,803,562 A 9/1998 Jacobs et al.
5,876,093 A 3/1999 Williams
5,893,607 A * 4/1999 Trimnell ..... A47C 7/70 108/27
5,961,179 A * 10/1999 Dixon ..... A47B 21/00 297/156
6,010,186 A * 1/2000 Tsay ..... A47B 39/06 297/158.4
6,039,392 A 3/2000 Dencker
6,102,475 A * 8/2000 Hamann ..... A47B 83/02 108/27
6,296,408 B1 * 10/2001 Larkin ..... A47B 83/001 400/681
6,619,735 B1 * 9/2003 Ming-Hwa ..... A47C 3/30 297/170
6,928,932 B1 * 8/2005 Ferrill ..... A47B 37/00 108/23
7,314,248 B2 * 1/2008 Mabon ..... A47B 9/08 297/118
7,530,632 B2 5/2009 Kaloustian et al.
8,141,949 B2 * 3/2012 Baru ..... A47B 21/00 297/172
8,616,629 B2 * 12/2013 Jonsson ..... A47B 83/02 297/171
2006/0071513 A1 4/2006 Pedemonte
2006/0278770 A1 12/2006 MacLeod
2008/0000400 A1 1/2008 Curry
2010/0013276 A1 * 1/2010 Tholkes ..... A63B 21/4047 297/174 R
2010/0148542 A1 * 6/2010 Zidulka ..... A61G 5/1059 297/174 R
2016/0302571 A1 * 10/2016 McBride ..... A47B 19/06

FOREIGN PATENT DOCUMENTS

CN 201131458 10/2008
WO 2012053879 4/2012

* cited by examiner

PORTABLE OFFICE

CLAIM OF PRIORITY

This application claims no priority to any previous United States patent application.

FIELD OF THE EMBODIMENTS

This invention relates to a portable desk apparatus. In particular the invention relates to an apparatus that provides a complete office experience that may be easily transported from location-to-location.

BACKGROUND OF THE EMBODIMENTS

In today's world, it is difficult to find a businessperson who does not do at least some of their business while on-the-go. While portable electronic devices enable a businessperson to do much of their business remotely, many professionals find that sometimes there is no substitute for working with paper. However, working with paper in remote locations can provide a number of challenges, particularly with regard to finding a suitable surface to place and manipulate these papers. Thus, the need for a device that allows a businessperson to work with papers in remote locations exists that can be carried with them exists.

Further, this type of device would be beneficial in schools with limited space. Ever since the "Baby Boomer" generation began to have children, schools have become more and more crowded, making space a premium in many locations. Definitionally, a portable desk apparatus must be able to be collapsed so that it takes up minimal space. Therefore, in schools where space is a premium, such a device could be used for students to write on during school hours, and then the device could be collapsed so that the space could be repurposed after-hours.

Examples of related art are described below:

U.S. Pat. No. 5,413,400 to Llanes discloses a desk and folding chair combination wherein the chair includes a seat, a back, support legs, and two arms, the arms are spaced generally parallel from one another and extend outwardly. This provides support for the attached desk, which is adjustably and pivotally connected to one of the arms. The desk, when in use, spans the extending arm portions and is swingable for access by a user to the seat. Further, an enlarged support base structure is provided to give stability to the support base structure extending beneath the desk so as to enlarge the zone of support beneath the desk.

U.S. Pat. No. 3,178,220 to Kaake discloses a sturdy, yet light-weight desk and chair combination. This desk and chair combination has a unified chair and desk support which allows the desk and chair combination to be folded into a thin, flat, compact package that requires only minimum of storage space.

U.S. Pat. No. 5,685,602 to Williams discloses a collapsible desk and chair apparatus which includes a one piece desk member having two pairs of support legs which are pivotally connected to each other and to a seat unit which is pivotally connected to both a desk member and one of the pairs of support legs. The other pair of support legs are pivotally and moveably connected to the underside of the desk member.

U.S. Pat. No. 5,876,093 to Williams discloses a collapsible desk and reinforced chair apparatus, which includes a one piece desk member that has support legs that are pivotally connected to each other and to a seat unit which is pivotally connected to a desk member. A seat reinforcement unit is also connected between the seat unit and one of the support legs. This device also contains a pair of telescoping sleeve elements, which rotate a latch cam element during the extension and retraction phases of the collapsible desk.

None of the art described above addresses all of the issues that the present invention does.

The need for an apparatus that provides for a storable and portable office space is clear. However, the prior art fails to provide for a system that enables a user to enjoy a complete office experience while traveling. A device that provided for this experience would provide a benefit to all manner of traveling businesspeople.

SUMMARY OF THE EMBODIMENTS

The present invention is an apparatus, comprising: a desk member having a top surface and a bottom surface; a seat member having a top surface and a bottom surface; a first pair of legs comprising: a first front member having a top portion and a bottom portion, and a first back member having a top portion and a bottom portion, wherein said top portion of said first pair of legs is pivotally attached to said bottom surface of said seat member; a second pair of legs comprising: a second front member having a top portion and a bottom portion, and a second back member having a top portion and a bottom portion, wherein said top portion of said second pair of legs is pivotally attached to said bottom surface of said seat member; a first support member, wherein said first support member is attached to said first front member and said second front member; a second support member, wherein said second support member is attached to said first front member and said second front member; a desk support member, having a top portion, a bottom portion, and a top surface; a desk attachment mechanism, having a top portion and a bottom portion, wherein said bottom portion is connected to said desk support member, and, wherein said top portion is connected to said desk member; a chair attachment mechanism; and an attachment member.

In general, the present invention employs a series of components that are pivotally attached to each other. This provides the benefit that the apparatus may be held in one position (e.g. while in use as a desk), but will still retain the ability to be easily rotated into a different position when desired (e.g. when the user would like to transport the apparatus). It should be noted that there are many different ways in which the components of the apparatus are pivotally attached. Further, the pivotal nature of the attachment of the different components of the apparatus will allow for the apparatus to become substantially flat while remaining substantially connected.

The present invention provides benefits to members of a number of different industries. Any member of any industry that engages in a large amount of travel will be aided by this invention. The present invention allows a user to enjoy the comfort and convenience of an office while on-the-go.

It is an object of the present invention to provide a mean for users to enjoy a full office experience while traveling.

It is an object of the present invention to allow a business person to use papers while away from the office.

It is an object of the present invention to provide a means to improve efficiency.

It is an object of the present invention to provide a portable office apparatus.

DESCRIPTION OF THE PREFERRED EMBODIMENTS

Figure 1:
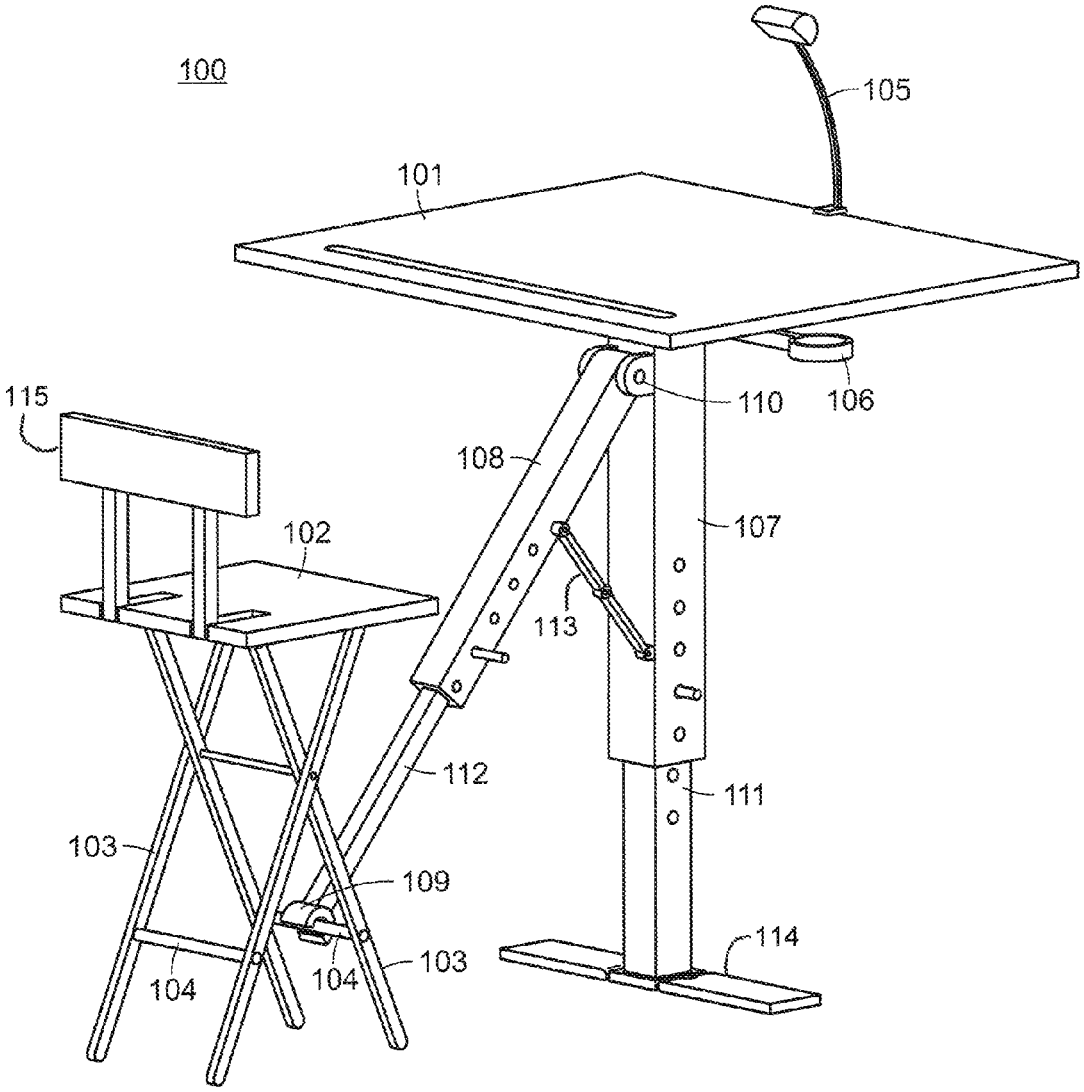
FIG. 1 shows a front perspective view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

In a preferred embodiment, the apparatus is comprised of a desk member, a seat member, two pairs of legs to support the seat member, two support members to provide lateral support for the two pairs of legs, a desk support member, an attachment member to connect the desk support member to one of the support members. In a preferred embodiment, there is a seat component and a desk component that are removably attached. The seat component is comprised of the seat member, two pairs of legs, and two support members laterally attached to the two pairs of legs. The desk component is comprised of the desk member, the desk support member, the attachment member, and the optional attachment mechanism. The optional attachment mechanism allows the desk component to be removably attached to either of the support members in the chair component.

In a preferred embodiment, the apparatus is optionally equipped with a cup holder. This functionality allows a user to enjoy a beverage without running the risk of the beverage spilling all over whatever items are placed on the desk member of the apparatus. In yet another preferred embodiment, the apparatus is equipped with a power source and a light. The power source may be comprised of, but is not limited to a battery, a means for connecting to a standard AC/DC circuit, or solar power cell. The inclusion of a light provides for the additional benefit of being able to use the apparatus in a wider variety of locations. For example, the apparatus may be used in a poorly-lit room, or during the night time. Due to the portable nature of the apparatus, and the apparatus' intended use, the inclusion of a light is particularly beneficial.

In yet another preferred embodiment, the attachment means is capable of being extended or collapsed. This disclosure contemplates many different extension mechanisms. For example, a scissor-linkage extension mechanism could be used. If this type of linkage were to be employed it should be constructed out of a light weight, yet sturdy material. Other suitable extension mechanisms include, but are not limited to, cam lock extension systems, pin lock extensions systems, and lever lock extension systems. Generally, these systems work by having multiple pieces comprising the attachment mechanism and said pieces are held in the extended positions together by each of the aforementioned mechanisms. To collapse the extension mechanism, the locking mechanism is disengaged, and then the pieces are moved into the collapsed position.

It should be considered that while not necessary, it might be desirable to include feet at the bottom portions of the two pairs of legs and the desk support member. This would be desirable to provide additional friction between the apparatus and the ground such that the apparatus would have the feeling of being sturdier. In a preferred embodiment, the height of each respective foot is adjustable to accommodate the use of the apparatus on uneven ground.

Referring to FIG. 1, a front perspective view of an embodiment of the apparatus of the invention is provided for. This view highlights the desk member, the seat member, the desk support member, the slip light, the cup holder, the attachment member, the optional attachment extension member. Specifically, this embodiment of the invention is comprised of two separable portions; a desk portion and a seat portion. Here, the desk portion is comprised of desk member 101 attached to the top end of desk support member 107. Inside of desk support member 107, is desk extension member 111. Desk extension member 111 is slidably engaged with desk support member 107, and in a preferred embodiment is secured via a standard pin lock mechanism. In a preferred embodiment, feet 114 are attached to the lowest portion of desk extension member 111. However, it should be appreciated that feet 114 can be attached to any portion of desk extension member 111 to provide additional support. The desk portion is also comprised of desk attachment mechanism 110, which is connected to attachment member 108. Desk attachment mechanism allows attachment member 108 to rotate between an extended position and a collapsed position. In this figure, it is shown in the extended position. Attachment member 108 can be optionally attached to support bracket 113 to provide additional support and stabilization. Attachment extension member 112 is slidably engaged with attachment member 108 and in a preferred embodiment is secured via a standard pin lock mechanism. In another preferred embodiment, attachment extending member 112 is optionally equipped with chair attachment mechanism 109. In yet another preferred embodiment, the desk portion may also be optionally equipped with slip light 105 and cup holder 106. A person having skill in the art will recognize that if a pin lock mechanism is employed, the pin will be attached to the desk portion by, for example, a string or bungee cord (not pictured).

In addition to the desk portion, apparatus 100 is also comprised of a chair portion, comprising, seat member 102 is attached to foldable seat back 115. Further, seat member 102 is attached to pair of legs 103. Pairs of legs 103 are supported by support members 104*a* and 104*b*, which are attached perpendicularly to pair of legs 103. In a preferred embodiment, chair attachment mechanism 109 will separably attach to either support members 104, allowing for apparatus 100 to be used as intended by the inventor.

Figure 2:
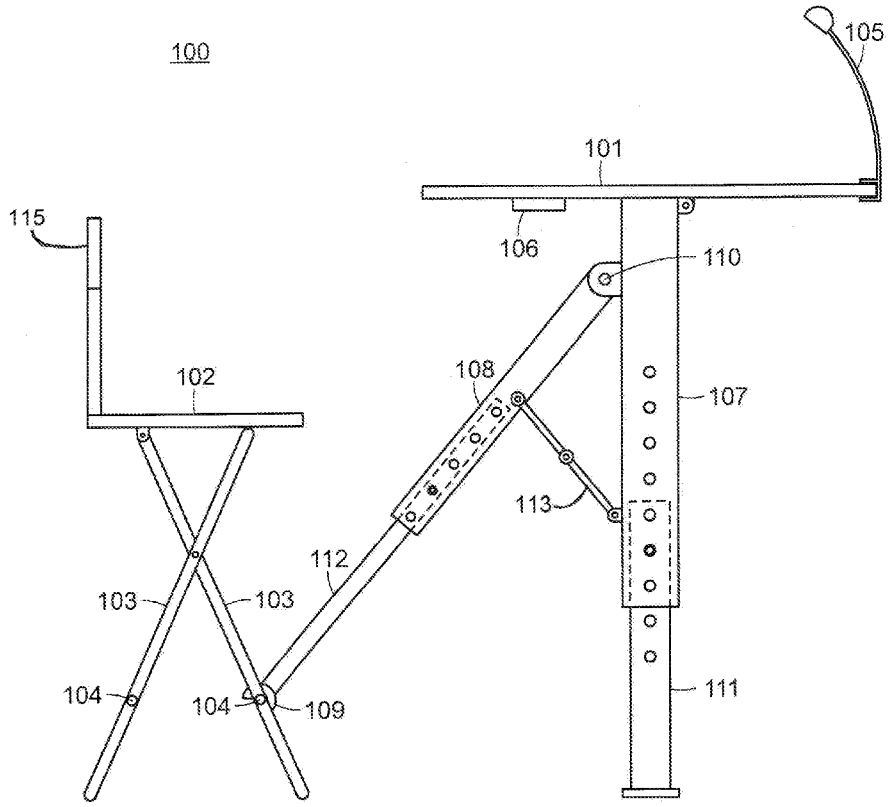
FIG. 2 shows a side view of an embodiment of the present invention.

Referring to FIG. 2, a side view of an embodiment of the present invention is shown. This view is intended to highlight the relationship between attachment member 108 and attachment extending member 112, as well as the relationship between desk support member 107 and desk extension member 111. In one embodiment, attachment extending member 112 and desk extension member 111 are slidably engaged with attachment member 108 and desk support member 107, respectively. These components allow the height and length of the apparatus in the extended position to be adjusted to fit the needs of a user. This allows the device to be suitable for adult business people as well as adolescent students.

Figure 3:
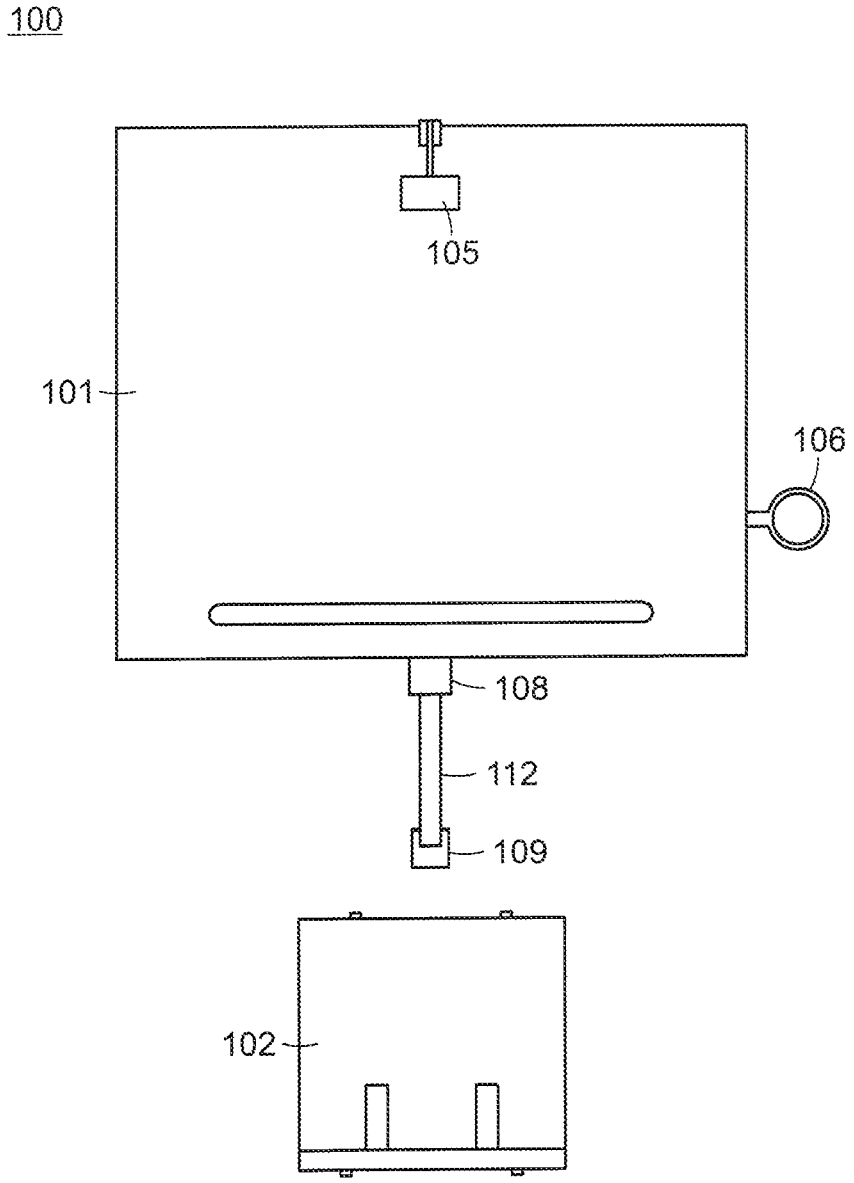
FIG. 3 shows a top view of an embodiment of the present invention with the desk member and chair member being separated.

Referring to FIG. 3, a top view of an embodiment of the present invention with the desk member and chair member being separated is shown. This view highlights the fact that the apparatus 100 is comprised of two separate portions, a desk portion and a seat portion that are separably attached.

Figure 4:
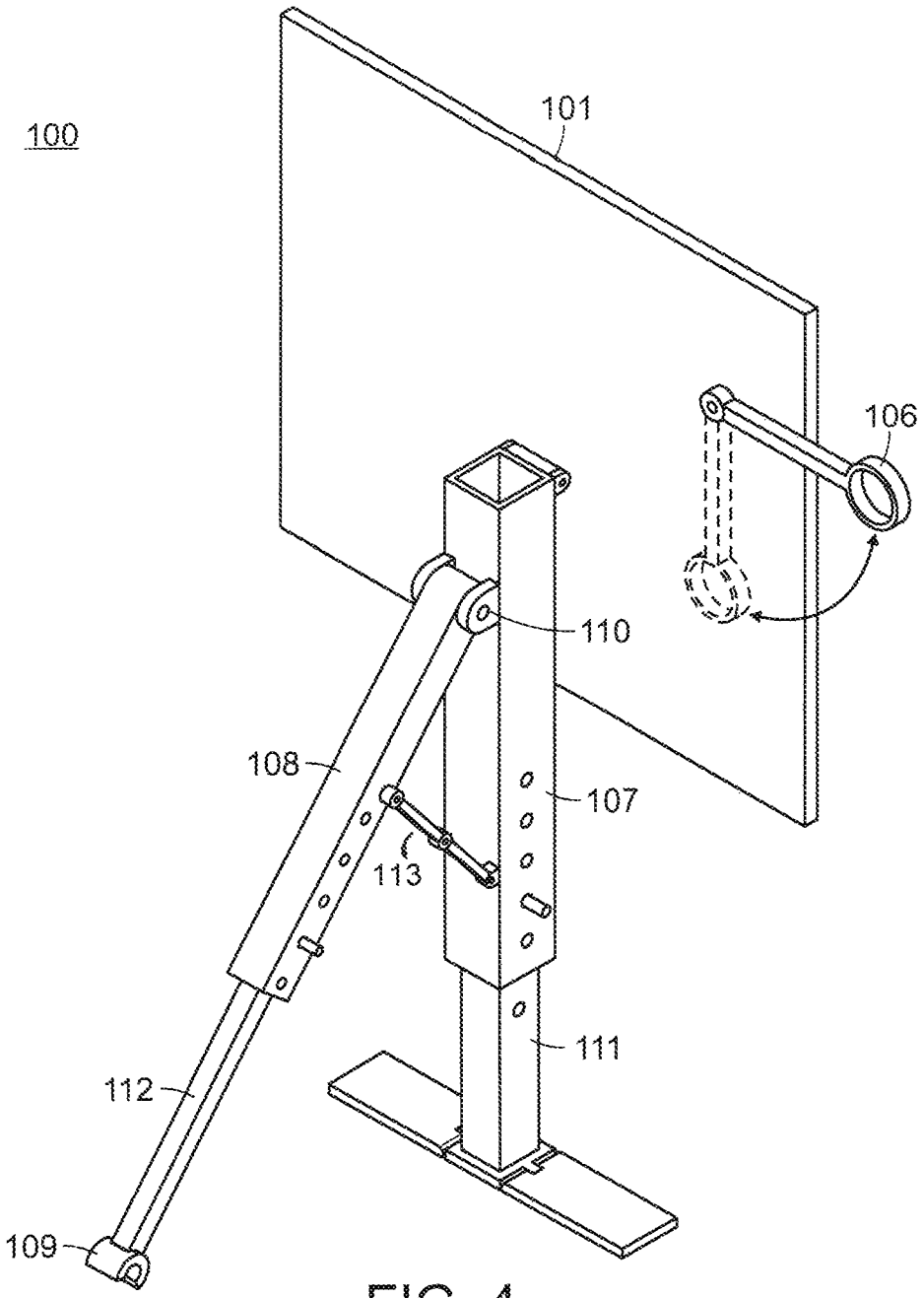
FIG. 4 shows a perspective view of an embodiment of the desk portion of the apparatus of the present invention.

Referring to FIG. 4, a perspective view of an embodiment of the desk portion of the apparatus present invention is shown. This view highlights the functionality of optional cup holder 106. In a preferred embodiment, the cup holder will rotate beneath desk member 101 when the desk portion is in the collapsed position.

Figure 5:
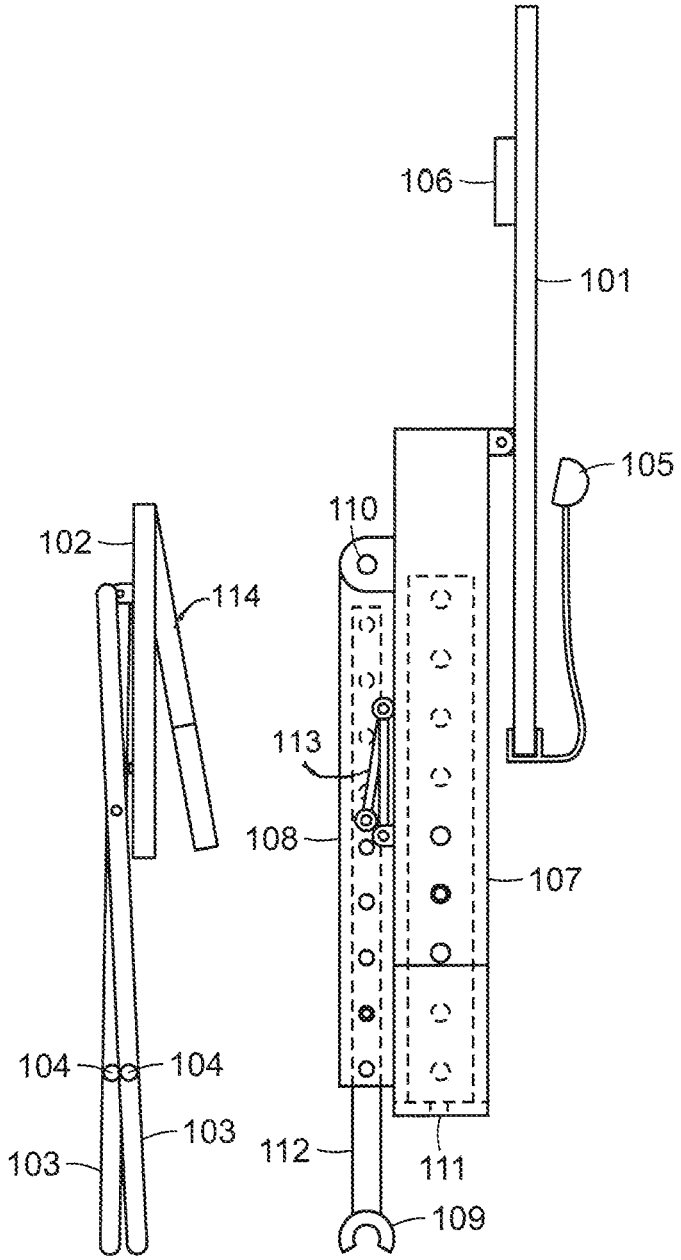
FIG. 5 shows a side view of an embodiment of the present invention with both the desk member and the chair member in a collapsed position.

Referring to FIG. 5, a side view of an embodiment of the present invention with both the desk member and the chair member in a collapsed position is shown. This view highlights how the apparatus 100 is collapsed so that it may be stored and carried easily. In particular, the desk portion and chair portion are separated and individually collapsed. For optimal portability, attachment extending member 112 and desk extension member 111 are fully recessed within attachment member 108 and desk support member 107, respectively.

Although this invention has been described with a certain degree of particularity, it is to be understood that the present disclosure has been made only by way of illustration and that numerous changes in the details of construction and arrangement of parts may be resorted to without departing from the spirit and the scope of the invention.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

What is claimed is:

1. An apparatus, comprising:
- a desk member having a top surface and a bottom surface;
- a seat member having a top surface and a bottom surface;
- a first pair of legs comprising:
  - a first front leg having a first front top portion and a first front bottom portion, and
  - a first back leg having a first back top portion and a first back bottom portion,
  - wherein said first pair of legs is pivotally attached to said bottom surface of said seat member;
- a second pair of legs comprising:
  - a second front leg having a second front top portion and a second front bottom portion, and
  - a second back leg having a second back top portion and a second back bottom portion,
  - wherein said second pair of legs is pivotally attached to said bottom surface of said seat member;
- a first support member,
  - wherein said first support member is attached to said first front leg and said second front leg;
- a second support member,
  - wherein said second support member is attached to said first front leg and said second front leg;
- a desk support member, having a top portion, a bottom portion, and a top surface;
- a desk extension member,
  - wherein said desk extension member is slidably engaged with the desk support member, and
  - the desk extension member employs a securing means to secure the position of the desk extension member within the desk support member;
- at least one ground support,
  - wherein said at least one ground support is pivotally attached to the desk extension member;
- a desk attachment mechanism, having a top portion and a bottom portion,
  - wherein said bottom portion is connected to said desk support member, and,
  - wherein said top portion is connected to said desk member;
- a chair attachment mechanism; and
- an attachment member,
  - wherein the attachment member further comprises:
    - an attachment extending member,
    - wherein said attachment extending member is slidably engaged with the desk attachment mechanism, the attachment extending member employing a securing means to secure the position of the attachment extending member within the attachment member, and wherein said attachment extending member is attached to the chair attachment mechanism.

2. The apparatus of claim 1, further comprising:
- a cup holder,
  - wherein said cup holder is pivotally attached to the desk member.

3. The apparatus of claim 2, wherein said cup holder is rotatable.

4. The apparatus of claim 1, further comprising:
- a power source; and
- a light source,
  - wherein said light source is operatively connected to the power source.

5. The apparatus of claim 1, further comprising:
- a seat back member,
  - wherein said seat back member is pivotally attached to the seat member.

6. The apparatus of claim 1, further comprising:
- a support member, wherein said support member is pivotally attached to the attachment member as well as the desk support member.

7. The apparatus of claim 6, wherein said support member is permanently attached to said attachment member.

8. The apparatus of claim 1, further comprising a cushion attached to said seat member.

9. The apparatus of claim 1, further comprising a hanging means.

10. The apparatus of claim 1, wherein said desk member is equipped with a lip for receiving writing utensils.

* * * * *